US008069981B2

(12) United States Patent
Buse

(10) Patent No.: US 8,069,981 B2
(45) Date of Patent: Dec. 6, 2011

(54) HINGED LID BOX FOR CIGARETTES

(75) Inventor: Henry Buse, Visselhövede (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 0 days.

(21) Appl. No.: 12/919,522

(22) PCT Filed: Mar. 6, 2009

(86) PCT No.: PCT/EP2009/001618

§ 371 (c)(1),
(2), (4) Date: Aug. 26, 2010

(87) PCT Pub. No.: WO2009/109396

PCT Pub. Date: Sep. 11, 2009

(65) Prior Publication Data

US 2011/0005948 A1 Jan. 13, 2011

(30) Foreign Application Priority Data

Mar. 7, 2008 (DE) ..... 10 2008 013 173

(51) Int. Cl.
*B65D 85/10* (2006.01)

(52) U.S. Cl. ..... 206/273

(58) Field of Classification Search ..... 206/242, 206/271, 273; 229/106, 160.1
See application file for complete search history.

(56) References Cited

U.S. PATENT DOCUMENTS

| | | | | |
|---|---|---|---|---|
| 5,487,468 | A | 1/1996 | Sheahan | |
| 6,168,014 | B1 * | 1/2001 | Manservigi et al. | 206/268 |
| 2004/0173668 | A1 * | 9/2004 | Conti et al. | 229/146 |
| 2005/0121340 | A1 * | 6/2005 | Spatafora | 206/259 |
| 2006/0006078 | A1 * | 1/2006 | Vaccari et al. | 206/273 |
| 2006/0213789 | A1 * | 9/2006 | Ghini et al. | 206/268 |

FOREIGN PATENT DOCUMENTS

| | | |
|---|---|---|
| CN | 1767981 A | 5/2006 |
| DE | 0204933 | 12/1986 |
| DE | 3645111 | 12/1990 |
| DE | 20101554 | 3/2001 |
| DE | 10314375 | 10/2004 |
| WO | 2004/085271 | 10/2004 |

OTHER PUBLICATIONS

Office Action from State Intellectual Property Office of the People's Republic of China (Aug. 2, 2011).

* cited by examiner

*Primary Examiner* — Jacob K Ackun
(74) *Attorney, Agent, or Firm* — Laurence P. Colton; Smith Risley Tempel Santos LLC

(57) ABSTRACT

A cigarette pack of the hinge-lid box type in which box side walls (24) and lid side walls (25) are correspondingly formed as a polygonal chain from adjoining wall portions (27, 28, 29), and the wall portions (27, 28, 29) are designed with the same width and directed at the same angles to one another and to the front side and rear side of the pack.

7 Claims, 4 Drawing Sheets

$$y = \frac{t}{\tan 30°}$$

$$x = f(d, t)$$

$$x = (3d + 2t - y) \bullet \tan\left(\frac{30°}{2}\right)$$

$$x = \left(3d + 2t - \frac{t}{\tan 30°}\right) \bullet \tan\left(\frac{30°}{2}\right)$$

HINGED LID BOX FOR CIGARETTES

STATEMENT OF RELATED APPLICATIONS

This application is the Patent Cooperation Treaty (PCT) Chapter II National Phase of and claims the benefit of PCT International Application No. PCT/EP2009/001618 having an International Filing Date of 6 Mar. 2009, which in turn claims priority on German Patent Application No. 10 2008 013 173.3 having a filing date of 7 Mar. 2008

BACKGROUND OF THE INVENTION

1. Technical Field

The invention relates to a cigarette pack of the hinge-lid type, with a box part, a lid and a collar which preferably consists of a separate blank, wherein box side walls and lid side walls consisting of mutually partially overlapping side flaps are formed by wall portions adjoining one another in a polygon-like manner, which wall portions are arranged symmetrically in relation to an (imaginary) central plane of the pack.

2. Prior Art

A cigarette pack of the aforementioned type having beveled (upright) pack edges is known, with the result that the pack has an overall octagonal contour (EP 0 204 933). The obliquely directed material strips in the region of the pack edges are adapted to the dimension of the cigarettes and are narrow in relation to a transversely directed, central material strip.

BRIEF SUMMARY OF THE INVENTION

The object on which the invention is based is to propose a new type of pack in which an improved adaptation of the outer contour to the shape of the pack contents, namely to a cigarette block, is provided, wherein it is ensured that the pack can be produced by machine and also can be readily handled by the consumer.

To achieve this object, the hinge-lid box according to the invention is characterized in that the side walls of the box part and of the lid consist of at least five wall portions, of which a central wall portion points transversely to the front side or rear side of the pack and at least in each case two wall portions are formed at both sides of the central wall portion and are directed at an acute external angle to one another, to the central wall portion and to the front side and rear side of the pack.

A pack contour which is attractive in external appearance, machine-producible and optimal in terms of feel provides that the side walls of the box part and lid consist of five wall portions which have the same width and are arranged at the same (external) angles to one another, in particular in each case at an angle of 30°.

A further particular feature of the pack according to the invention is that mutually overlapping and interconnected border regions of the side flaps of the box part and lid do not overlap one another with a full surface, but with a slight offset, with the result that a free edge of the outer border flap is set back with respect to a directly adjacent folding edge.

The collar consisting of an independent blank is adapted to the contour of the pack through the formation of collar side flaps which are formed in a polygon-like manner, including a border web in the region of a wall strip facing the rear side of the pack.

Furthermore, corner flaps of the pack, namely bottom corner flaps and end corner flaps, are formed with a particular contour and connect to the side flaps in the region of the border strips. The position of the corner flaps is selected in such a way that in the finished pack the polygon-like outer contour of the corner flaps bears in a supporting manner on partial regions of the side wall.

BRIEF DESCRIPTION OF THE DRAWINGS

Further details of the pack according to the invention are explained in more detail below with reference to the drawings, in which.

DETAILED DESCRIPTION OF PREFERRED EMBODIMENTS

Figure 4:
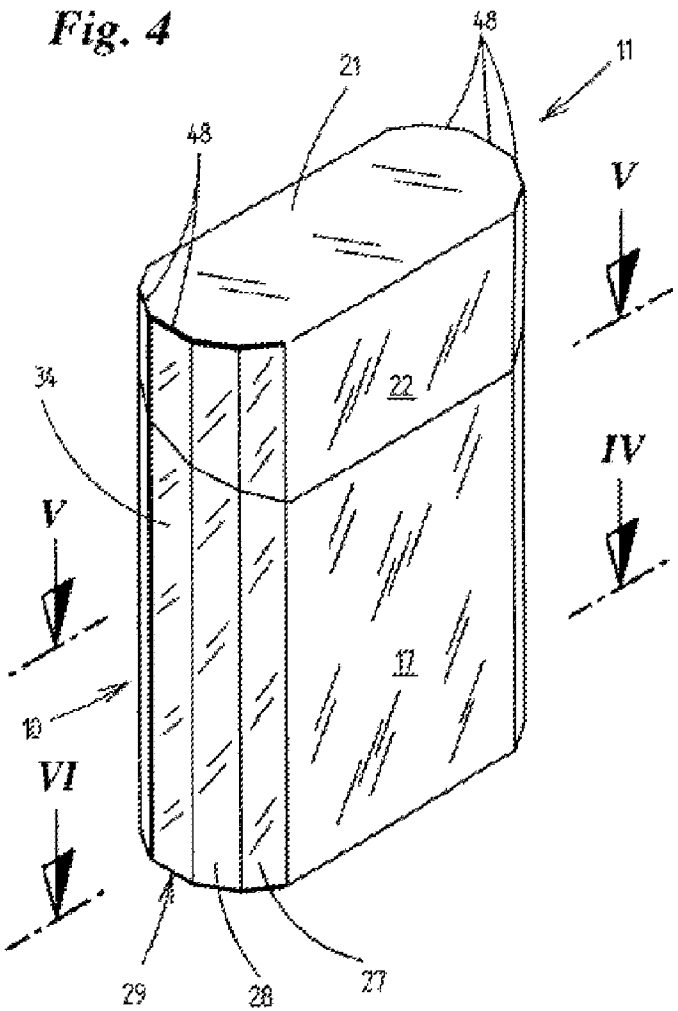
FIG. 4 shows the pack according to FIG. 3 in the closed position, likewise in perspective.

What is concerned is the external shape and structural design of a cigarette pack of the hinge-lid box type. According to the standard structure of this pack type, a (lower) box part 10 and a lid 11 are pivotably connected to one another in the rear region of the pack by a linear articulation 12. The lid 11 can be moved between a closed position according to FIG. 4 and an open position according to FIG. 3. The box part 10 and lid 11 form a unit.

A collar 13 is arranged within the pack. This collar consists of a collar front wall 14 and collar side flaps 15, 16. The collar 13 is anchored in the box part 10 by way of a lower anchoring region, in particular, by adhesive bonding. An upper region of the collar 13 is enclosed by the lid 11 in its closed position.

Figure 1:
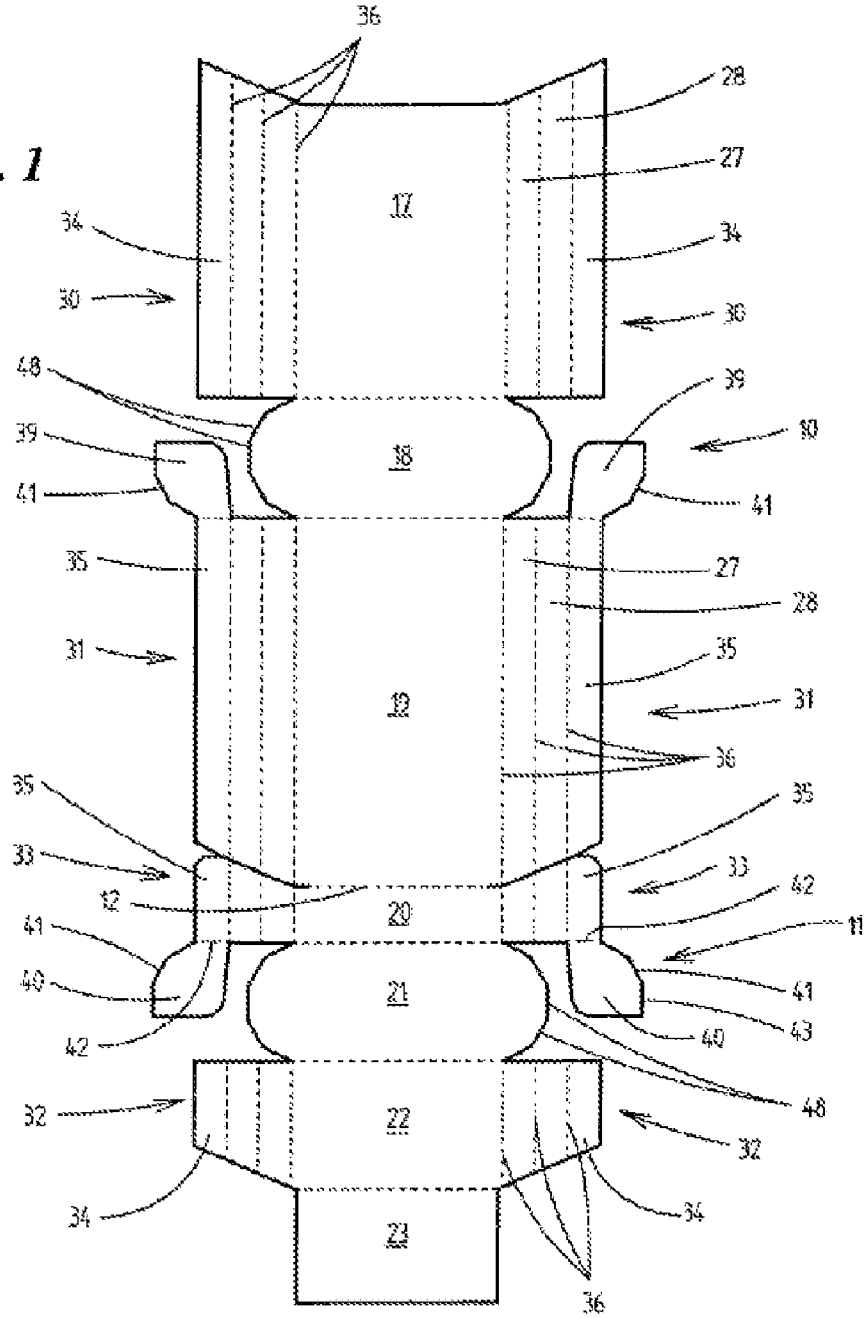
FIG. 1 shows a spread-out blank for a pack of the hinge-lid box type.

The box part 10 and lid 11 consist of a one-piece blank, in particular in the configuration according to FIG. 1. The blank is constructed on the principle of longitudinal folding, with successive regions for a box front wall 17, bottom wall 18, box rear wall 19, lid rear wall 20, end wall 21, lid front wall 22 and lid inner flap 23. The linear articulation 12 is formed between the box rear wall 19 and lid rear wall 20.

Side walls of the pack, namely box side walls 24 and lid side walls 25, are formed in a particular way. The mutually opposite box side walls 24 are correspondingly designed. The same applies to the lid side walls 25 which correspond to the box side walls 24 in terms of the contour.

The side walls 24, 25 are designed as an outwardly directed polygonal chain with a plurality of strip-shaped wall portions 27, 28, 29 directed at an acute (external) angle 26 to one another. Advantageously, all the wall portions 27, 28, 29 are designed with the same width and directed at the same angles to one another, wherein a particular design applies with respect to the central wall portion 29. Accordingly, the side walls 24, 25 are symmetrically designed with respect to an (imaginary) central plane of the pack.

The central wall portion 29 is transversely directed, namely transversely to the front wall 17, 22 or to the rear wall 19, 20.

Side flaps of the blank, namely front box side flaps 30 and side flaps 31, which are assigned to the box rear wall 19, are connected to one another in the region of the wall portion 29, in particular by adhesive bonding. Likewise, front lid side flaps 32 are connected to one another with rear side flaps 34 in the region of the lid. The side flaps 30, 31, 32, 33 are connected to assigned front and rear walls of the pack, namely to box front wall 17, box rear wall 19, lid rear wall 20 and lid rear wall 22. The side flaps 30, 31, 32, 33 are tailored in terms of dimensions and design to the shape of the side walls 24, 25. Each side flap 30, 31, 32, 33 is divided into a plurality, here three, material strips, namely to form the wall portions 27, 28 and with a marginal outer portion 34 and an outer border portion 34 and an inner border portion 35 in the region of all the side flaps 30, 31, 32, 33. The material strips 27, 28 and 34, 35 are marked in the region of the side flaps 30, 31, 32, 33 by a corresponding number of parallel folding lines 36. These are in particular embossing lines, but if appropriate also material weak points produced by surface perforations etc. The folding lines 36 are designed in such a way that in the finished pack they each define pronounced folding edges 37.

Figure 6:
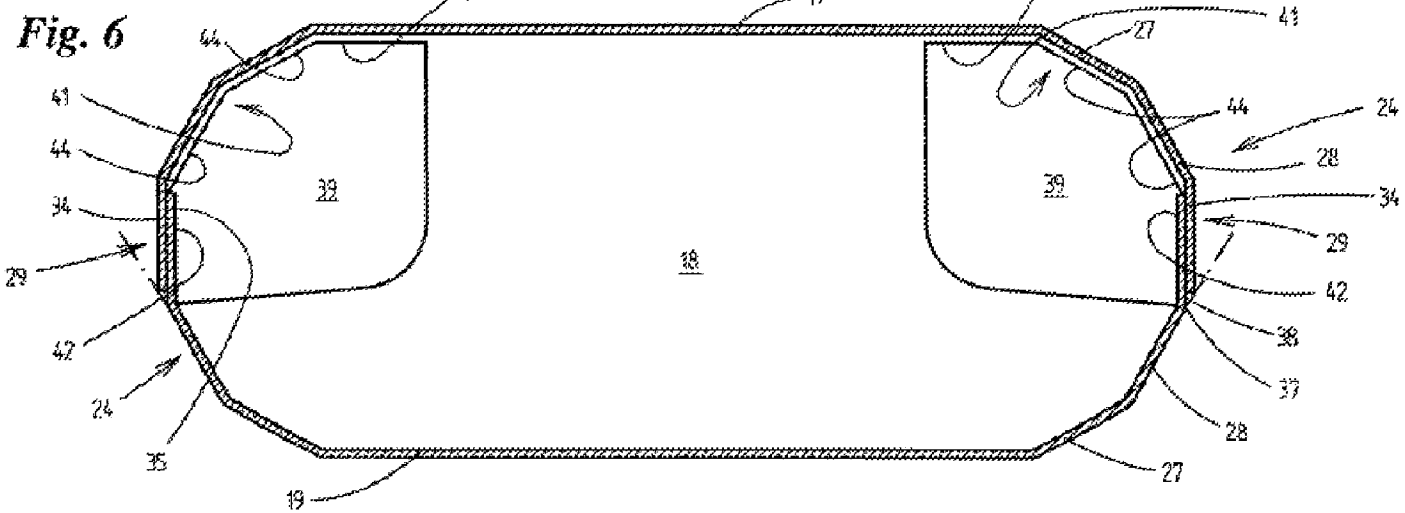
FIG. 6 shows a cross section analogous to FIG. 5 in the section plane VI-VI of FIG. 4 without cigarettes.

The border legs 34, 35 are preferably designed in the same width as the wall portions 27, 28. With full-surface, exact overlapping of the mutually assigned border legs, 34, 35, there results a (double-layer) central wall portion 29 which has the same width as the wall portions 27, 28. In the exemplary embodiment shown, the border legs 34, 35 are positioned with a slight offset to one another, with the result that a free border edge 38 of the outer border leg 34 is slightly set back with respect to an adjacent folding edge 37 in such a way that the border edge 38 does not project beyond an (imaginary) plane in the continuation of the plane of the adjacent wall portion 28 (dot-dashed line in FIG. 6). The central wall portion 29 thus has a greater width than the adjacent wall portions 27, 28.

A further particular feature is the formation of corner flaps. Bottom corner flaps 39 are arranged on the inner border legs 35 of the box side walls 24, and lid corner flaps 40 are arranged on the corresponding inner border legs 35 of the lid side walls 25. The corner flaps 39, 40 bear on the assigned transverse walls, namely, on the one hand, on the inner side of the bottom wall 18 and, on the other hand, on the end wall 21. The corner flaps 39, 40 are correspondingly designed in a particular shape. A flap edge 41, which is outwardly directed in the case of the unfolded blank, has a polygon-like contour with three edge portions adjoining a transversely directed folding line 42, the dimensions of which edge portions are adapted to the dimensions of the wall portions 27, 28. An edge portion 43 bears on the inner side of the box front wall 17 or of the lid front wall 22. The adjacent edge portions 44 each bear on wall portions 27, 28 facing the front side of the pack. The corner flaps 39, 40 produce an additional stabilization of the pack in the region of the side walls 24, 25.

Figure 2:
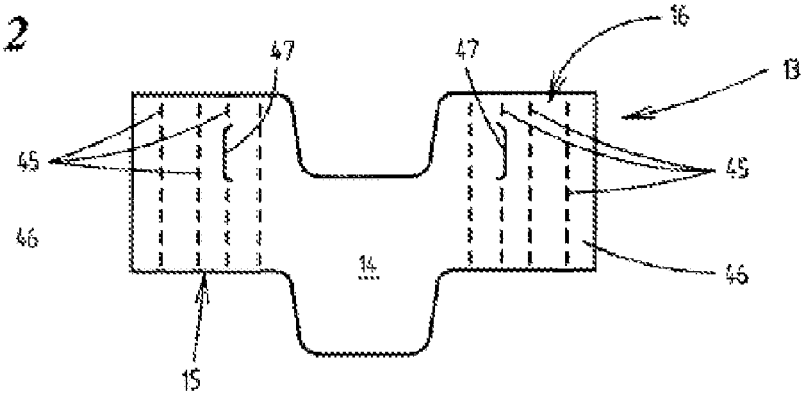
FIG. 2 shows a likewise spread-out blank for a collar of such a pack.
Figure 3:
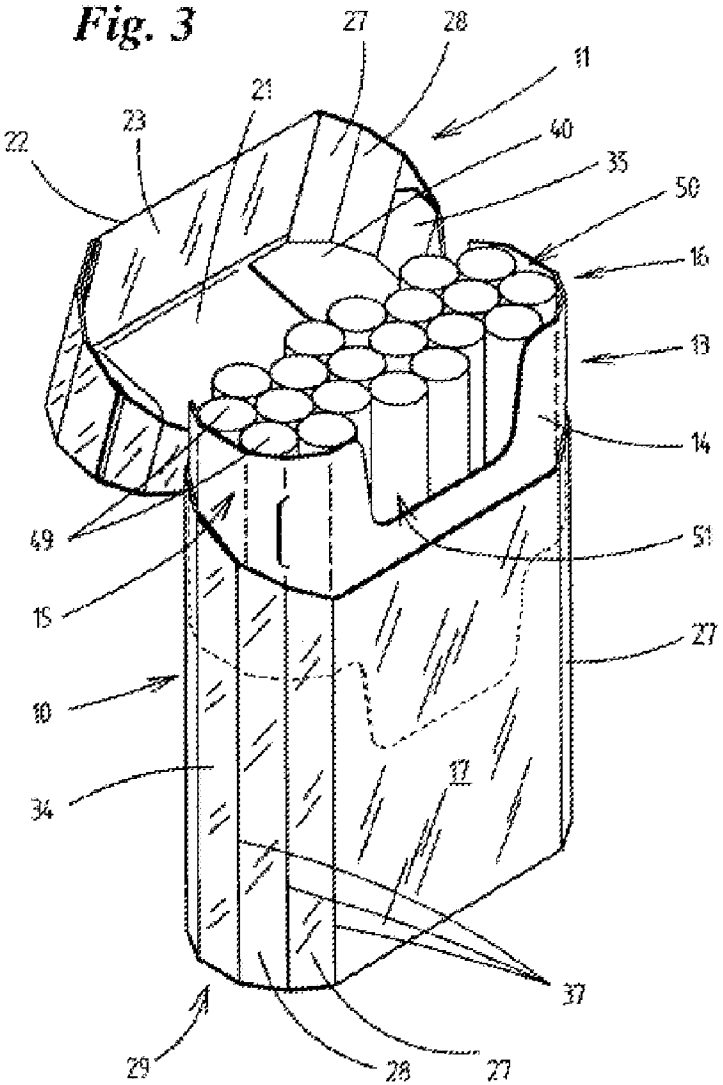
FIG. 3 shows a cigarette pack of the hinge-lid box type with the lid opened, in a perspective representation.
Figure 5:
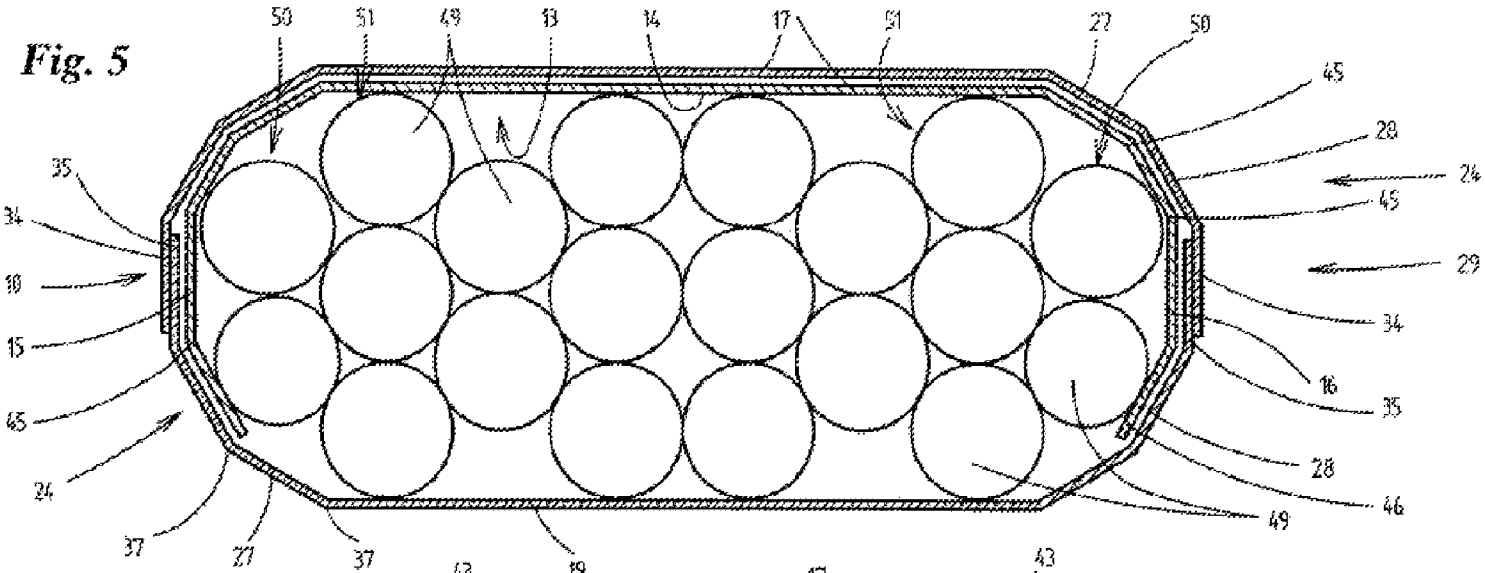
FIG. 5 shows a cross section of the pack according to FIG. 4 in the section plane V-V, on an enlarged scale.

The collar 13, whose collar front wall 14 bears on the inner side of the box front wall 17, is designed in the region of the collar side flaps 15, 16 in such a way that a fitting, positive contact with the inner side of the box side walls 24 and, when the pack is closed, with the lid side walls 25 is provided. The lid side flaps 15, 16 are provided with folding lines 45, in particular with embossing or perforation lines, which produce a polygon-like folding of the collar side flaps 15, 16. The material strips thus formed bear in a fitting manner on the inner side of the wall portions 27, 28, 29 of the box part 10 (FIG. 5). The collar side flaps 15, 16 are dimensioned in such a way that they extend beyond the center of the pack or beyond the central wall portions 29, namely with a border strip 46 in the region of the wall portion 28 assigned to the rear side of the pack. A closing aid, namely a tab 47 formed substantially by C-shaped punching, is not arranged in the region of an inside folding line 45 adjoining the collar front wall 14, or in the region of a folding edge formed by this folding line, but in the region of an adjacent folding line (FIG. 2). As a result, this closing aid is set back with respect to the front side of the pack (FIG. 3).

The lower and upper pack walls, namely bottom wall 18 and end wall 21 are adapted to the contour of the pack. Both walls 18, 21 have free borders which are designed as a uniform polygon, consisting of five edge sections 48. The shape, arrangement and dimension of these edge sections 48 correspond to the contour of the side walls 24, 25. The edge sections 48 or the entire free edge of the pack walls 18, 21 butt obtusely against the assigned free upper and lower borders of the wall portions 27, 28, 29.

The pack contents is a group of cigarettes 49. These are formed in a particular way with adaptation to the contour of the pack. The cigarettes 49 are arranged in transversely directed rows 50, 51, wherein the marginal row 50, which faces the side walls 24, 25 of the pack, consists of two cigarettes situated next to one another and the adjacent row 51 consists of three cigarettes. The cigarettes 49 of adjacent rows 50, 51 are oriented offset with respect to one another, that is to say "in a saddle position". Also possible is a formation with three or four cigarettes 49 per row 50, 51 with a corresponding dimension of the pack.

The cigarettes 49 are arranged in a formation which increases the stabilization of the pack. The two cigarettes 49 of the outer row 50 bear on wall portions 28, adjacent to the central wall portion 29. The outer cigarettes 49 of the adjacent row 51 bear on the front walls 17, 22 on the one hand and the rear walls 19, 20 on the other hand, specifically in a region adjacent to the marginal wall portion 27. Further rows 51 of three cigarettes 49 situated next to one another are formed in the central region of the pack, in the exemplary embodiment according to FIG. 5 on both sides of an (imaginary) central transverse plane.

The cigarette group is expediently enclosed by an inner blank 52 of paper, tin foil or the like.

Figure 7:
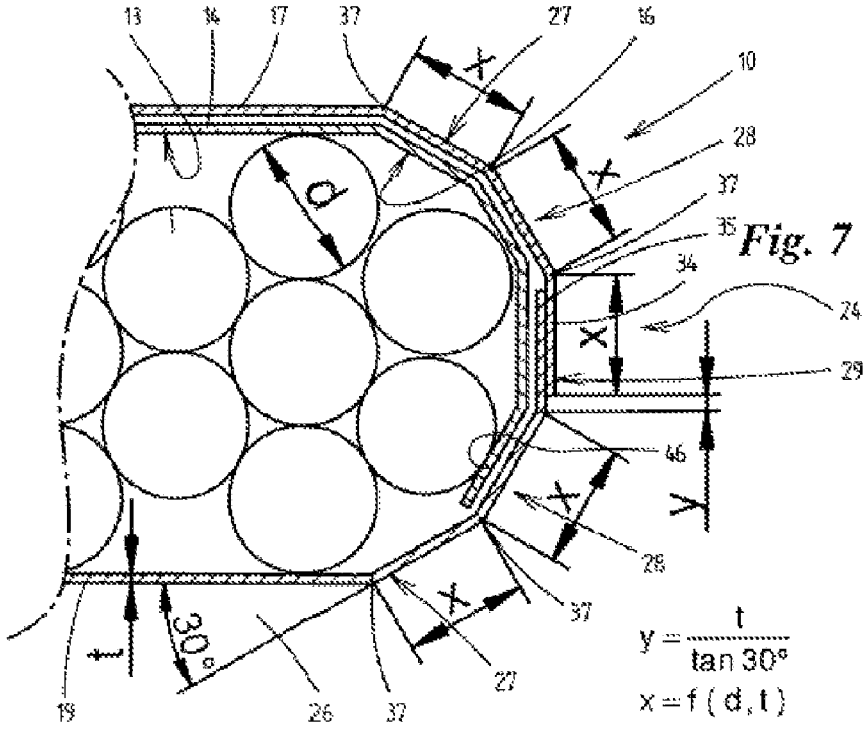
FIG. 7 shows a partial cross section of the pack with dimension indications.
Figure 8:
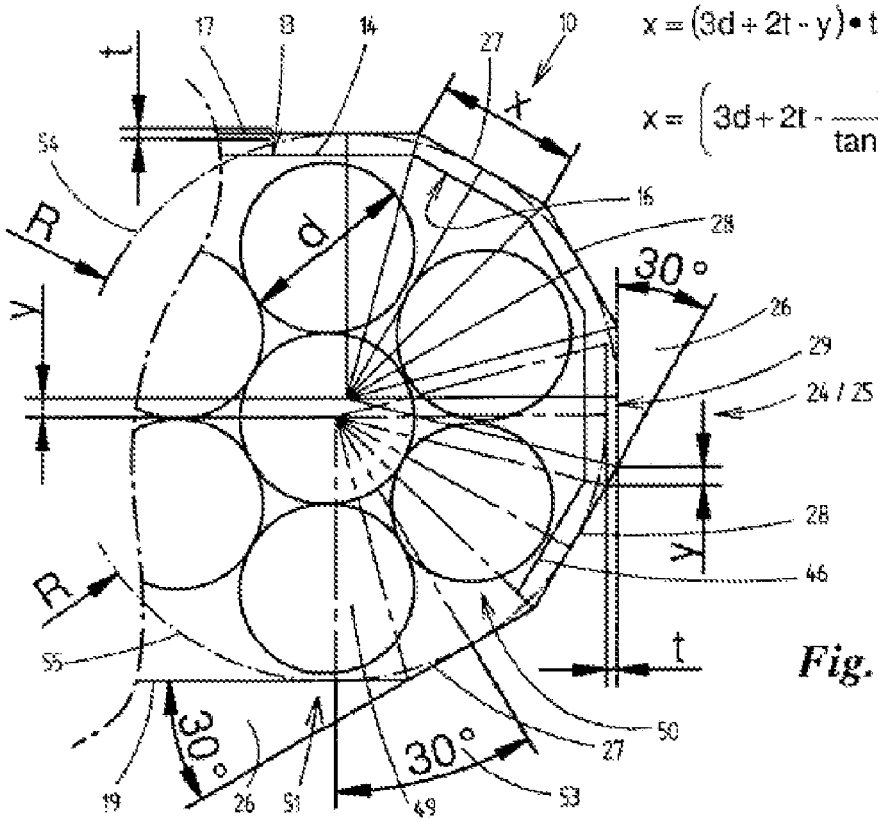
FIG. 8 shows a representation analogous to FIG. 7 with plotted dimension lines and a calculation formula.

The geometry on which the design of the pack in the region of the side walls 24, 25 is based is explained in FIG. 7 and FIG. 8 with reference to the present exemplary embodiment. Accordingly, there results a correlation between the width, designated by x, of the wall portions 27, 28, 29 on the one hand and their angle of inclination 26. For the embodiment represented, this angle 26 is 30°. This results in a radial angle 53 of the same size. This angle defines the angular spacing between imaginary radial planes from folding edge 37 to folding edge 37 of a wall portion 27, 28, 29. Furthermore, the same-sized radial angle 53 sweeps between imaginary radial central planes of adjacent wall portions (FIG. 8). The dimensions and angular position of the wall portions 27, 28, 29 are also in a ratio to the diameter d of the cigarettes 49.

Moreover, in the exemplary embodiment in FIG. 7, FIG. 8, the offset y of the border legs 34, 35 in the region of the central wall portion 29 is taken into consideration. This offset y is in a ratio to the thickness t of the packaging material, that is to say in particular the cardboard. Taking these predetermined variables into consideration, the width x of a wall portion 27, 28 can be calculated as follows:

$$y = \frac{t}{\tan 30^\circ}$$

-continued $$x = f(d, t)$$

$$x = (3d + 2t - y) \cdot \tan\left(\frac{30°}{2}\right)$$

$$x = \left(3d + 2t - \frac{t}{\tan 30°}\right) \cdot \tan\left(\frac{30°}{2}\right)$$

The offset y is repeated within the pack if the wall portions 27, 28, 29 are assigned inner circles 54, 55 as an (imaginary) variable. The inner circles 54, 55, on which the wall portions 27, 28, 29 bear exactly tangentially, are offset from one another with respect to the circle centerpoint owing to the offset y on the one hand and the material thickness t on the other hand. It is possible through these geometrical correlations to determine the exact shape of the pack or of the side walls 24, 25 as a function of variable dimensions such as material thickness t, diameter of the cigarettes d, in order to represent the particular polygonal shape of the side walls.

LIST OF REFERENCE NUMBERS

10 Box part
11 Lid
12 Linear articulation
13 Collar
14 Collar front wall
15 Collar side flap
16 Collar side flap
17 Box front wall
18 Bottom wall
19 Box rear wall
20 Lid rear wall
21 End wall
22 Lid front wall
23 Lid inner flap
24 Box side wall
25 Lid side wall
26 Angle
27 Wall portion
28 Wall portion
29 Wall portion
30 Box side flap
31 Box side flap
32 Lid side flap
33 Lid side flap
34 Border leg
35 Border leg
36 Folding line
37 Folding edge
38 Border edge
39 Bottom corner flap
40 Lid corner flap
41 Flap edge
42 Folding line
43 Edge portion
44 Edge portion
45 Folding line
46 Border strip
47 Tab
48 Edge section
49 Cigarette
50 Row
51 Row
52 Inner blank
53 Radial angle
54 Inner circle
55 Inner circle

What is claimed is:

1. A cigarette pack of the hinge-lid type with a box part (10), lid (11), front side, and rear side, and a collar (13) which consists of a separate blank, the box part (10) comprising box front wall (17), box side walls (24), bottom corner flaps (39), and side flaps (30, 31), and the lid (11) comprising lid front wall (22), lid side walls (25), lid corner flaps (40), and side flaps (32, 33), wherein:

a) the box side walls (24) and the lid side walls (25) consist of wall portions (27, 28, 29) which are formed in a polygon-like manner and are directed at an obtuse angle to one another, of which central, transversely directed wall portions (29) consist of interconnected border flaps which are transversely directed with respect to the front side and the rear side of the pack, b) the box side walls (24) and the lid side walls (25) correspondingly consist of five wall portions (27, 28, 29) adjoining one another at obtuse angles, c) at both sides of the central transversely directed wall portion (29) there are arranged in each case two wall portions (27, 28) directed at an angle to the central transversely directed wall portion (29) and to one another, d) all of the wall portions (27, 28, 29) are directed at an identical external angle (26) of 30° to one another, d) all five of the wall portions (27, 28, 29) are designed with a same width (x), e) the bottom corner flaps (39) and the lid corner flaps (40) are arranged on a marginal material strip (35) of inner side flaps (31) of the box part (10) and of inner side flaps (33) of the lid (11), f) the corner flaps (39, 40) have an outer contour which is adapted to the contour of the side walls (24, 25), having an outwardly directed flap edge (41) with a plurality of partial edges arranged at an angle to one another corresponding to the relative position and dimension of the wall portions (27, 28, 29), in such a way that the flap edge (41) bears positively in a supporting manner on wall portions (27, 28) and on a partial region of the box front wall (17) and of the lid front wall (22), g) a group of cigarettes (49) as pack contents forms a formation within the pack having transversely directed rows (50, 51), with a marginal row (50), located at the side walls (24, 25), of two cigarettes (49) situated next to one another in the transverse direction and with an adjacent row (51) of three cigarettes (49) situated next to one another with an offset arrangement to the cigarettes of the marginal row (50), and h) cigarettes (49) of the marginal row (50) bear on the wall portions (28) adjacent to the central transversely directed wall portion (29), and cigarettes (49) of the adjacent row (51) consisting of three cigarettes (49) bear on the front wall (17, 22), adjacent to the wall portion (27).

2. The cigarette pack as claimed in claim 1, wherein the central transversely directed wall portion (29) consists of two mutually overlapping and interconnected border legs (34, 35), of the box side flaps (30, 31) and the lid side flaps (32, 33), wherein the border legs (34, 35) are arranged with a slight offset (y) to one another in such a way that an outer free border edge (38) of the border leg (34) does not project beyond an imaginary plane of the directly adjacent wall portion (28).

3. The cigarette pack as claimed in claim 2, wherein the wall portions (27, 28, 29) and the border legs (34, 35) have a width that is determined as a function of the diameter (d) of the cigarettes (49) and of the thickness (t) of the packaging material from which the pack is made.

4. The cigarette pack as claimed in claim 1, wherein the collar (13) consisting of a separate blank forms a collar front wall (14) with collar side flaps (15, 16), wherein the collar side flaps (15, 16) have foldable material strips which are defined by folding lines (45) and which bear in a fitting manner on an inner side of the wall portions (27, 28, 29).

5. The cigarette pack as claimed in claim 4, wherein the collar side flaps (15, 16) have a border strip (46) which projects away beyond the region of the central transversely directed wall portion (29) and which bears with its full surface on one of the wall portions (28).

6. The cigarette pack as claimed in claim 4, further comprising a tab (47) formed by C-shaped punching that is assigned as a closure aid for the lid (11) in the region of a central folding line (45) of the collar side flaps (15, 16) which is set back from the box front wall (17).

7. The cigarette pack as claimed in claim 1, wherein the pack further comprises a bottom wall (18) and an end wall (21) having a free edge facing the side walls (24, 25) and which is formed as a polygonal chain, with edge sections (48) which are arranged at an obtuse angle to one another and which bear in a fitting manner on the wall portions (27, 28, 29) of the side walls (24, 25).

* * * * *